United States Patent [19]

Vielhauer

[11] Patent Number: 5,025,536

[45] Date of Patent: Jun. 25, 1991

[54] PANT'S CLIP APPARATUS

[76] Inventor: Elizabeth A. Vielhauer, 2841 "D" West Long Dr., Littleton, Colo. 80120

[21] Appl. No.: 521,947

[22] Filed: May 11, 1990

[51] Int. Cl.[5] ..... A41F 1/00

[52] U.S. Cl. ..... 24/563; 24/543; 2/114; 297/188

[58] Field of Search ..... 24/563, 545, 543, 541, 24/49 C, 49 CC; 128/20; 2/114, 227; 297/188

[56] References Cited

U.S. PATENT DOCUMENTS

| | | | |
|---|---|---|---|
| 1,214,794 | 2/1917 | Kilkenny | 24/543 |
| 1,456,990 | 5/1923 | Montgomery | 24/543 |
| 2,049,660 | 8/1936 | Patten | 24/563 |
| 2,085,715 | 6/1937 | Kayn | 24/49 CC |
| 2,706,517 | 4/1955 | Dexter et al. | 297/188 |
| 3,580,633 | 5/1971 | Du Priest | 297/188 |
| 3,701,348 | 10/1972 | Navara . | |
| 4,380,999 | 4/1983 | Healy . | |
| 4,511,158 | 4/1985 | Varga et al. | 297/188 |
| 4,616,633 | 10/1986 | Vargas Garcia . | |
| 4,651,353 | 3/1987 | Walden | 2/114 |
| 4,694,826 | 9/1987 | Chester . | |

*Primary Examiner*—Victor N. Sakran
*Attorney, Agent, or Firm*—Henderson & Sturm

[57] ABSTRACT

A pant's clip apparatus comprising an elongated, generally flattened, elliptical clip member with straight sides and overlapping ends. One of the ends of the clip member is formed into a curved hook portion which overlies the other end of the flat clip member. The intermediate portion of the clip member forms a curved resilient hinge element.

3 Claims, 1 Drawing Sheet

PANT'S CLIP APPARATUS

TECHNICAL FIELD

The present invention relates to the field of clothing article clips in general, and in particular to a pant's clip device that is designed to assist a patient confined to a wheelchair in keeping the front of their pants down during the act of catheterization.

BACKGROUND ART

This invention was the subject matter of Document Disclosure Program Registration No. 239,885 which was filed in the U.S. Patent and Trademark Office on Nov. 20, 1989.

As can be seen by reference to the following U.S. Pat. Nos. 3,701,348; 4,380,999; 4,616,633; and 4,694,826; the prior art is replete with myriad and diverse retractor devices designed to space one surface from another.

While all of the aforementioned prior art constructions and more than adequate for the basic purpose and function for which they have been specifically designed, these patented devices are neither designed nor intended to provide the particular purpose and function served by the present invention.

As anyone who has either administered a catheterization or who has been catheterized is aware, one of the most vexing problems encountered during the procedure when the patient is confined to a wheelchair is the fact that the front of the patient's pants must be continually held down during the procedure.

As a consequence of the foregoing situation, there has existed a longstanding need for a clip apparatus designed on one end to clasp and depress the front panel of a patient's pants while seated in a wheelchair, while the other end of the apparatus engages the front of a wheelchair or a wheelchair cushion, and the provision of such a construction is a stated objective of the present invention.

DISCLOSURE OF THE INVENTION

Briefly stated, the pant's clip apparatus that forms the basis of the present invention comprises an elongated, generally flattened, elliptical clip member having straight sides and overlapping ends.

In addition, one of the ends of the clip member is formed into a curved hook portion which overlies, in a quasi-safety pin fashion, the other end of the clip member which is flat. The intermediate portion of the clip member forms a curved resilient hinge element.

As will be explained in greater detail further on in the specification, the curved hook portion is used to grasp and depress the front panel or crotch of the user's pants, while the curved intermediate portion engages the front of the wheelchair or a wheelchair cushion.

In addition, in those instances when a wheelchair cushion is employed, the generally flat end of the clip apparatus is inserted between the cushion and the seat of the wheelchair such that the patient's weight will archor the flat end of the apparatus and the resilient intermediate hinge will permit the curved hook portion to be depressed into a retractive type of engagement with the front of the user's pants.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
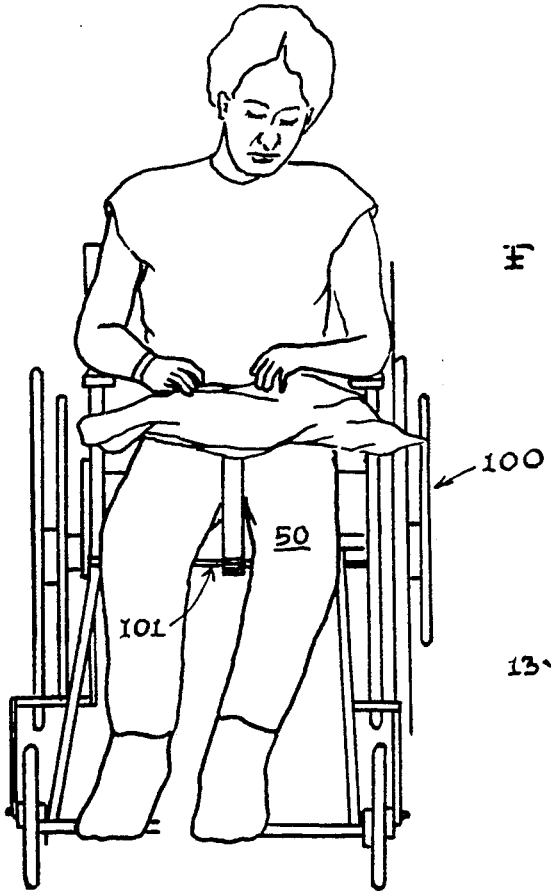
FIG. 1 is a front perspective view of the clip apparatus in use.

As can be seen by reference to the drawings, and in particular to FIG. 1, the pant's clip apparatus that forms the basis of the present invention is designated generally by the reference numeral (10). The apparatus (10) comprises a generally flat, thin, one-piece clip member (11) fabricated from a generally rigid, yet resilient material such as thin metal, plastic of the like and having a generally straigth end (12), a curved intermediate portion (13) and a curved end (14) forming a hook element (15).

Figure 5:
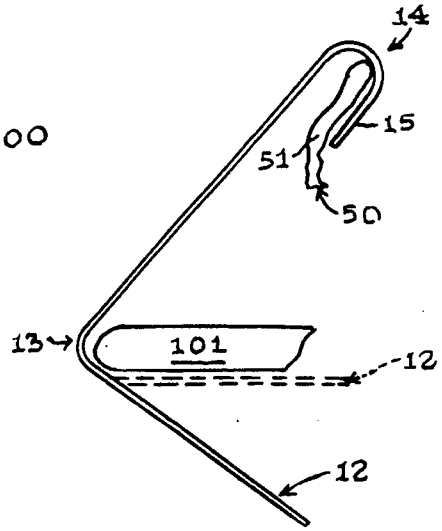
FIG. 5 is a detail view of the engagement of the apparatus with the patent's pants and a portion of the wheelchair.

As shown in FIGS. 2 through 5, the one-piece clip member (11) opens and closes in a quasi-safety pin fashion by depressing the straight end (12) relative to the curved end (14) and swinging the straight end (12) beyond either side of the curved end (14) to open the clip member (11) to the disposition illustrated in solid lines in FIG. 5.

Figure 2:
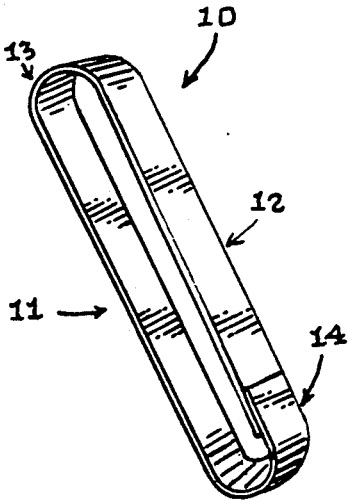
FIG. 2 is an isolated perspective view of the apparatus in its closed position.
Figure 3:
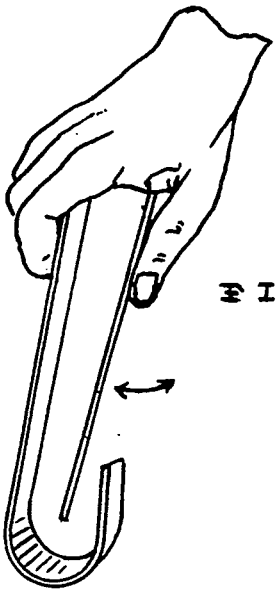
FIG. 3 is an isolated perspective view of the apparatus being opened for deployment.
Figure 4:
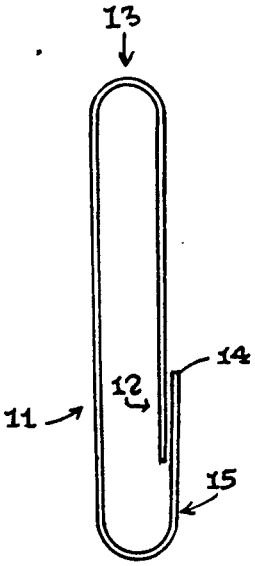
FIG. 4 is a side plan view of the apparatus.

As can also be seen by reference to FIGS. 2 through 4, the curved end (14) is dimensioned to overlie the generally straight end (12) of the clip member (11) to frictionally retain the clip member (11) in a closed disposition for storage purposes, wherein the clip member (11) assumes a generally elongated oval configuration having flattened sides.

In addition, the curvature and resiliency of the curved intermediate portion (13) of the clip member (11) causes the intermediate portion (13) to act as a resilient hinge element as depicted in FIG. 3.

As mentioned previously, and as can be seen particularly by reference to FIGS. 1 and 5, the clip apparatus (10) of this invention is designed to be used in conjunction with the seat cushion (102) and/or seat (101) of a wheelchair (100) to retract the front panel or crotch (51) of a patient's pants (50) while the patient is undergoing the process of catheterization.

As can best be seen by reference to FIG. 5, in the instance wherein no seat cushion (102) is present, the curved end (14) will be hooked over the front panel (51) of the patient's pants (50) while the curved intermediate portion (13) of the clip member (11) will be hooked over the front edge of the seat (101) of the wheelchair.

Furthermore, in those instances wherein a wheel chair seat cushion (102) rests on the wheelchair seat (101), the generally straight end (12) of the clip member (11) is intended to be inserted in between the wheelchair seat (101) and seat cushion (102) in a generally horizontal disposition as depicted in phantom in FIG. 5. The user's weight will serve to keep the generally straight flat end (12) of the clip member (11) in a captive disposition in between the wheelchair seat (101) and seat cushion (102) in a well recognized manner.

Having thereby described the subject matter of the present invention, it should be apparent that many substitutions and variations of the invention are possible in light of the above teachings. It is therefore to be understood that the invention as taught and described herein is only to be limited to the extent of the breadth and scope of the appended claims.

I claim:

1. A pant's clip apparatus in combination with a wheelchair having a seat and a seat cushion for retracting the front panel of a pair of pants worn by a patient sitting in the wheelchair during a catheterization procedure wherein the clip apparatus comprises:

a generally flat resilient, thin, one-piece clip member having a generally straight end, a curved end forming a hook element, and a curved intermediate portion which acts as a flexible hinge element relative to said ends; wherein said curved end is dimensioned to overlie and releasably engage said straight end; and, wherein said curved intermediate portion is engageable with the front of the seat of the wheelchair when said curved end of the clip member engages the front panel of the patient's pants in a retracted disposition; wherein, the clip member is dimensioned to be received between the seat cushion and said seat.

2. The apparatus as in claim 1 wherein said one-piece clip member is fabricated from a generally resilient material.

3. The apparatus as in claim 1 wherein said one piece clip member is fabricated from a generally rigid material.

* * * * *